United States Patent [19]

Favot

[11] Patent Number: 4,872,667

[45] Date of Patent: Oct. 10, 1989

[54] WEIGHT LIFTING APPARATUS

[76] Inventor: Dino A. Favot, 3000 Amazon, Dearborn, Mich. 48120

[21] Appl. No.: 278,850

[22] Filed: Dec. 2, 1988

[51] Int. Cl.[4] ..... A63B 13/00

[52] U.S. Cl. ..... 272/123; 272/117

[58] Field of Search ..... 272/67, 68, 93, 116, 272/117, 118, 119, 122, 123, 124, 127, 128, 143, DIG. 4

[56] References Cited

U.S. PATENT DOCUMENTS

| | | | |
|---|---|---|---|
| 4,252,316 | 2/1981 | Price | 272/123 |
| 4,312,506 | 1/1982 | Brennan | 272/123 |
| 4,377,282 | 3/1983 | Hayes | 272/124 |
| 4,618,142 | 10/1986 | Joseph, Jr. | 272/123 X |
| 4,634,127 | 1/1987 | Rockwell | 272/118 X |
| 4,749,188 | 6/1988 | Montgomery | 272/123 |

*Primary Examiner*—Richard J. Apley
*Assistant Examiner*—Robert W. Bahr
*Attorney, Agent, or Firm*—Charles W. Chandler

[57] ABSTRACT

Weightlifting apparatus for increasing the effective weight by offsetting it from a shaft enclosed in a sleeve gripped by the user. The sleeve can rotate freely on the shaft through a limited angle, and the apparatus includes interlocking components to set the angle so that, during a final part of a lift, the center of mass of the weight will be farther from the user than it would be if it were mounted on a standard weightlifting bar that passed through the center of mass of the weight. Braces are attached to the sleeve and go in back of the user's forearms to provide assistance in supporting the weights in the offset position.

16 Claims, 2 Drawing Sheets

WEIGHT LIFTING APPARATUS

BACKGROUND OF THE INVENTION

This invention relates to weight lifting, or bodybuilding, equipment and particularly to apparatus using free weights to build up the biceps by performing an exercise known to bodybuilders as curling.

The exercise of curling can be performed using a long bar held horizontally by both hands near the ends or a short bar held horizontally in one hand. In either case, the exercise consists in moving the weighted bar in an arc from a lower position, usually near the bodybuilder's thighs, to an upper position near his shoulders. For the sake of simplicity, the following description will assume that the bar is a long one held in both hands.

The bodybuilder is supposed to keep his elbows approximately immobile and to move only his forearms and hands. The biceps have to exert the greatest force when the bar is in the mid region of the arc, since in that region, the motion of the bar is almost entirely vertical with a very small horizontal component. At the upper part of the arcuate movement, when the bodybuilder's hands and the weight bar held by them are moving more nearly horizontally than vertically to bring the bar near the bodybuilder's shoulders, the biceps are under relatively little stress. Bodybuilders speak of this position as a resting position because the biceps are not being stressed in a way that is considered beneficial in building up strength or musculature.

It has been proposed heretofore to shift the location of the center of mass of the weights so as not to be in line with the part of the bar held by the bodybuilder's palms. U.S. Pat. No. 4,327,908 to James discloses bodybuilding apparatus in which the part of the apparatus to which the weights are attached is positioned over the portion of the bodybuilder's forearms adjacent his wrists while an offset bar is held in the weight lifter's hands. This actually reduces the effect of the weights, since it brings the center of mass closer to the bodybuilder's elbow and thus gives an effect similar to using smaller weights held in the bodybuilder's hands.

U.S. Pat. No. 4,7565,526 to Broussard shows a different exercise device that has a sleeve rotatably mounted on a bar between two weights. The bar can pass through either of two holes in the weights, one of which is close to the center of mass of that weight and the other of which is near a part of the perimeter as far away from the center of mass as is possible. Inserting the ends of the bar into the latter holes offsets the center of mass, and the rotatable sleeve allows the weights to hang down during the exercise. In order to limit the freedom of rotation of the weights and force them to project forward when the bodybuilder's arms are near his shoulders, Broussard provides a second bar, called a leverage bar, that passes through another hole located in a part of each of the weights close to the center of mass but offset to one side thereof and in a fixed position relative to the center of mass. As the apparatus is moved through an arcuate path, a point is reached where the leverage bar engages the backs of the bodybuilders forearms, and from that point on through the rest of the arc, the leverage bar prevents any further turning motion of the weights relative to the main bar. The fact that the point at which the leverage bar becomes effective to prevent further rotation of the weights is fixed makes it impossible to change the effective force produced on the bodybuilder's biceps by adjusting that point or by changing the range over which the leverage bar will be effective. Moreover, the location of the leverage bar is such that, when it comes into use, the center of mass of the weights is closer to the bodybuilder's elbows than is the bar from which the weights are suspended. Thus, the effect on the bodybuilder is similar to the effect of using smaller, not larger, weights. In addition, the leverage bar is not in contact with the bodybuilder's forearms at all times but can pivot rather suddenly to strike them, which can be painful and even dangerous.

U.S. Pat. No. 4,231,569 to Rae shows apparatus that has certain similarities to the Broussard device. As in that device, the apparatus of Rae has a main bar held in the bodybuilder's hands and a second bar or structure offset therefrom to engage the backs of the bodybuilder's forearms after a certain point is reached during the arcuate movement of the main bar. Rae's structure is arranged so that the center of mass is out beyond the bodybuilder's hands during the upper part of the arcuate movement of the device, and this stresses his biceps as if larger weights were actually being used, which is an improvement over Broussard's device. However, Rae's device has the same fundamental disadvantages as Brousard's in that the second bar is placed in a fixed position relative to the position to which the weights are attached, which prevents the range of movements of the weights from being varied to change the amount of force that must be expended by the bodybuilder in performing curls and which allows the second bar to strike his forearms sharply at an intermediate point in the exercise.

SUMMARY OF THE INVENTION

The purpose of this invention is to provide weight lifting apparatus particularly for use in curling, although it may be used in certain other exercises. The apparatus allows the weights to be held under control during the entire movement of an exercise and to be positioned so that they are forward of the bodybuilder's hands during the upper part of the movement. The effect on the bodybuilder's muscles is the same as if a larger mass were being used starting at a selected point in the exercise. In the case of a curl, the upper part of the arcuate movement cannot be considered a resting part, because the bodybuilder's biceps are always under stress. At the same time, the bodybuilder's forearms are in no danger of being struck sharply or unexpectedly by any part of the apparatus.

The device of the present invention includes a bar with brackets attached to its ends and nonrotatably held there, at least while the device is being used. These brackets include means radially offset from the axis of the bar to support weights. A sleeve, which encircles the bar and is rotatable on it, is the part of the apparatus to be gripped by the person using the device, and in order to control the position of the weights at all times to cause them to be displaced away from the bodybuilder by a controllable amount, brace means are attached, not to the weights, but to the sleeve. The brace means extend outwardly from the sleeve and are located where they engage the backs of the bodybuilder's forearms at all times during the exercise. The sleeve is allowed to have only a limited amount of rotation so that the angle between the center of mass of the weights and the brace means, considering the axis of the sleeve as the apex of the angle, is preferably between about 60° and 180°. Since the brace means are not connected to a fixed point relative to the weights, the apparatus can include means to limit this angle to a smaller range.

Still further objects and advantages of the invention will become readily apparent to those skilled in the art to which the invention pertains upon reference to the following detailed description.

DESCRIPTION OF THE DRAWINGS

The description of the accompanying drawings in which like reference characters refer to like parts throughout the views, and in which.

DETAILED DESCRIPTION OF THE PREFERRED EMBODIMENT

Figure 1:
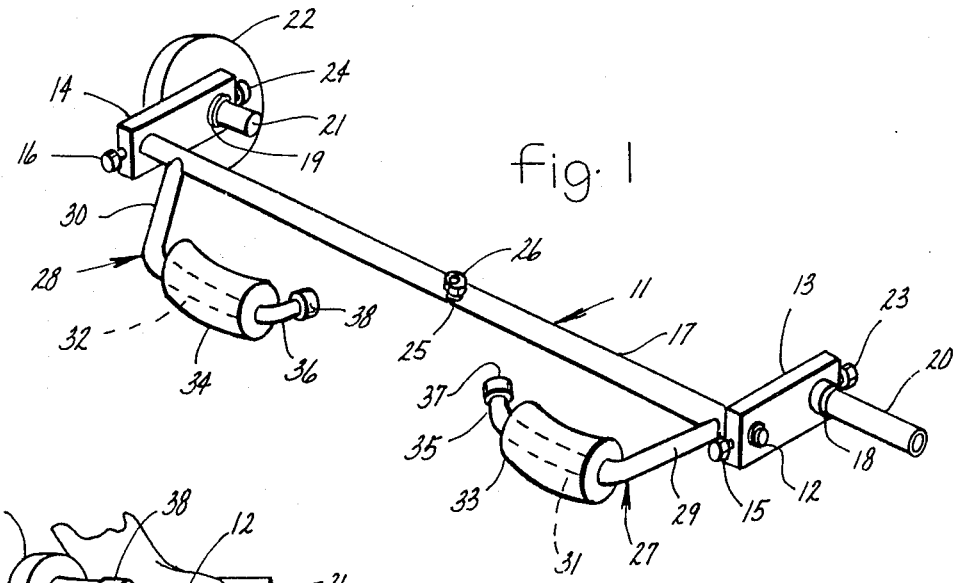
FIG. 1 is a perspective view of one embodiment of weight lifting apparatus according to this invention.
Figure 2:
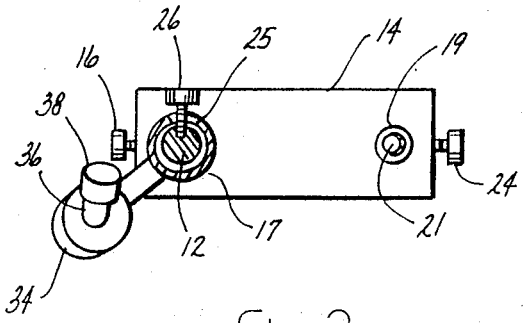
FIG. 2 is a cross-sectional view of the apparatus in FIG. 1 along the line 2—2 in FIG. 1.

Referring to FIGS. 1 and 2, the weight lifting apparatus 11 of the invention includes a bar 12 that has bracket means in the form of two flat bracket plates 13 and 14 held in position on the ends of the bar 12 by set screws 15 and 16 that extend through threaded holes in the brackets and engage the bar 12. A sleeve 17 is rotatably mounted on the bar 12 to serve as a hand grip structure for anyone using the apparatus. The brackets 13 and 14 are identical to each other, and each of them has a hole within which a short hollow tube 18 and 19, respectively, is permanently held in place, for example by being welded to the bracket in which it is located. The purpose of these short tubes is to provide stabilization for short bars 20 and 21, on which weights are to be placed. Only a single weight 22 is shown on the bar 21, and no weight is shown on the bar 20 in order not to hide other components of the structure. While two such bars are shown in FIG. 1, it is also possible to use one long bar that extends through both of the short tubes 18 and 19 and is somewhat longer than the bar 12. The brackets 13 and 14 have additional set screws 23 and 24 to hold the bars 20 and 21 in place or to hold a long bar in place, if one is used.

At the center of the sleeve 17 is an arcuate slot 25 through which extends a set screw 26 screwed into the bar 12. The purpose of the slot 25 and set screw 26 is to form pin-and-slot means to limit the angular movement of the sleeve 17, which may be considered a first relative rotation means, with respect to the bar 12, which may be considered a second relative rotation means.

The apparatus also includes brace means in the form of two rods 27 and 28. One end 29 and 30, respectively, of each of these rods is welded to the sleeve 17 near the outer ends of the sleeve and adjacent the portions of the sleeve gripped by a bodybuilder to use the apparatus 11. The ends 29 and 30 extend at an angle to the sleeve, but they lie generally in a plane common to the sleeve. This angle could be 90°, but it is not necessarily so. A central portion 31 and 32, respectively, of each of these rods extends generally parallel to the sleeve 17 and, thus, in approximately the same plane as the first ends 29 and 30. The central portions are enclosed within soft pads 33 and 34, the purpose of which is to protect the backs of the forearms of a person using the apparatus 11. This is because, when a bodybuilder grips the apparatus to perform a curl, his right hand will pass between the pad 31 and the sleeve 17 and will grasp the sleeve with his right thumb facing the bracket 13 and the pad 31 engaging the back of his right forearm. Conversely, his left hand will pass between the pad 32 and the sleeve and will grasp the sleeve 17 with his left thumb facing the bracket 14. The central parts 29 and 30 of the rods may be slightly curved to fit more comfortably around the bodybuilder's forearms. If they are curved slightly, they will still be substantially in the same plane as the sleeve 17 and the ends 29 and 30.

The rods 27 and 28 have free end portions 35 and 36 that are bent back somewhat toward the sleeve 17 but offset in such a way as not to lie in the same plane as the sleeve and the first ends 29 and 30 of the rods 27 and 28. The direction of offset of the end portions relative to the latter plane is opposite from the direction of offset of the slightly curved central portions 29 and 30. Protective rubber end caps 37 and 38 are placed on the tips of the end portions 35 and 36 to cover any sharp edges. The tips of the portions 35 and 36 could be joined to form a single rod generally parallel to, but spaced from, the sleeve 17. However, such a rod tends to get in the way of the abdomen of a bodybuilder using the apparatus, and it is desirable to divide the brace means into the two rods 27 and 28 and to provide the end portions 35 and 36 bent in a direction that will prevent their coming into contact with the abdomen of the bodybuilder.

Figure 3:
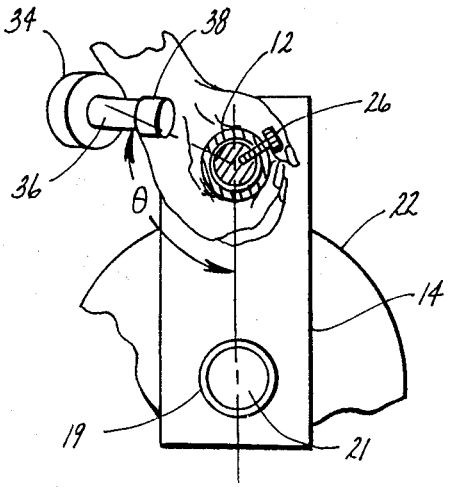
FIG. 3 shows the apparatus of FIG. 2 in the starting position of a curl.

FIG. 3 shows the position of the apparatus 11 at the beginning of a curl. In order to show the structure that limits angular movement of one part of the apparatus with respect to another, only half of the complete apparatus is shown. The force of gravity on the bracket 14 and on the center of mass of the weight 22, which is in line with the axis of the bar 21, causes the bracket to hang straight down, so that the axis of the bar 21 is directly under the axis of the bar 12. The set screw 26 extends through the slot 25 and is at the counterclockwise end of the slot. The angle $\theta$ between the center of mass of the weight and the brace rod 28 is at its maximum. In this embodiment, the maximum value of $\theta$ is about 150°, although it could be as much as 180°.

Figure 4:
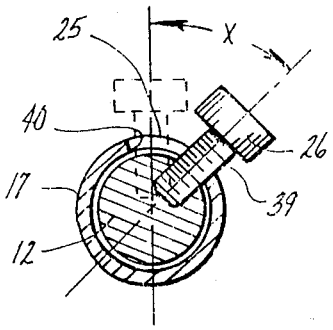
FIG. 4 shows an enlarged cross-sectional view of one embodiment of components to limit the angle through which the center of mass can shift relative to the brace means.

FIG. 4 shows an enlargement of a cross section of the bar 12 and the sleeve 17 at the slot 25. The slot has two limiting walls 39 and 40 at its ends, and the screw, which could also be considered a pin, can move back and forth through the angle in the slot. This angle is less than the full angle between the walls 39 and 40 due to the finite radius of the screw 26. It is clearer to show the structure as if the bar 12 were rotated rather than the sleeve 17, although it is the latter that is actually rotated by the bodybuilder's hands.

Figure 5:
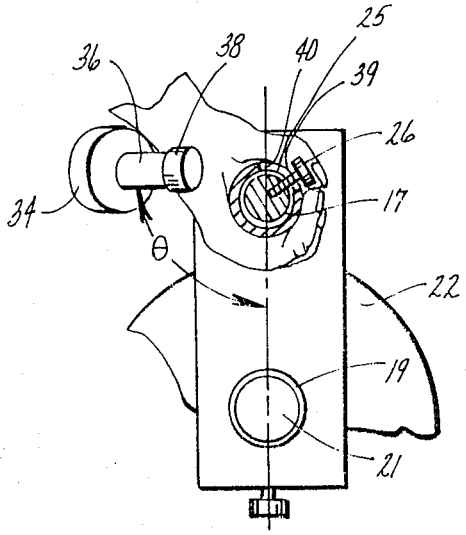
FIG. 5 shows the apparatus of FIG. 3 at a later point in the performance of a curl.

FIG. 5 shows the arrangement of the apparatus 11 after the bodybuilder has moved the bar 12 part of the way through the arc. The sleeve has been rotated by the bodybuilder enough to shift it so that the wall 39, rather than the wall 40, is against the screw 26. Any further movement of the bar 12 and sleeve 17 along the arc will cause the bracket 14 to start pivoting counterclockwise along with the sleeve 17. The angle $\theta$ between the rod 28 and the center of mass of the weight 22 is smaller than it was in FIG. 3 by the angular width of the slot 25.

Figure 6:
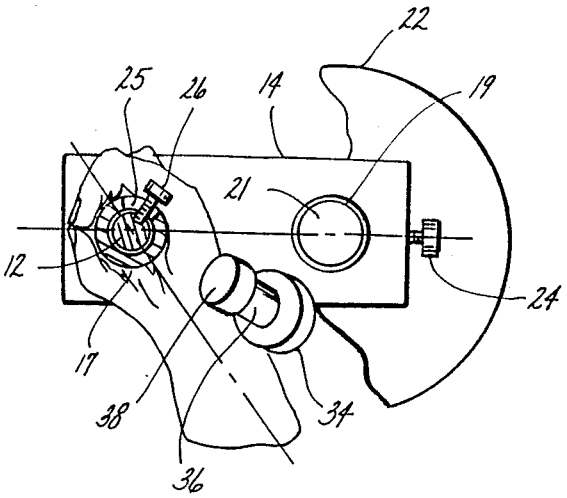
FIG. 6 shows the apparatus of FIG. 5 at the end point of a curl.

FIG. 6 shows the position of the apparatus 11 at the highest position of a curl. All of the slack permitted by the angular width of the slot 25 has been taken up by the time the bodybuilder's forearms reached the position in FIG. 5. Any further angular rotation of his arms about the pivot axis through his elbows causes a corresponding angular rotation of the bar 12. It is not necessary that the bodybuilder maintain an exceptionally tight grip on the sleeve 17; the pressure of the brace 28 or, more precisely, the pressure of the central portion 32 thereof through the pad 34, transfers some of the gravitational force of the weight to the back of the bodybuilder's forearm. However, the fact that the center of mass of the weight 22 projects forward applies the desired force to the bodybuilder's biceps.

Bodybuilders may not always want to have the slack afforded by the slot 25 taken up at the same angle. The angle at which this occurs can be varied by loosening the set screws 15 and 16 in FIG. 1 and twisting the bar 12 relative to the brackets 13 and 14. Then the set screws 15 and 16 must be retightened to hold the bar and brackets in the new position. However, resetting the bar 12 relative to the brackets 13 and 14 does not change the magnitude of the angle $\alpha$ (see FIG. 4) but just shifts its location.

Figure 7:
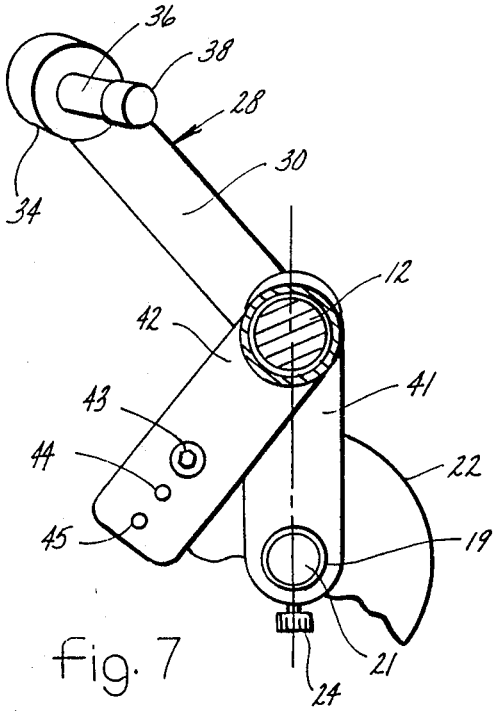
FIG. 7 shows a cross-sectional view of a modified embodiment of the invention.

FIG. 7 shows another way to achieve the same effect. The components shown in that figure include the bar 12 with the sleeve 17 rotatably mounted on it. A bracket arm 41 is rigidly attached to the end of the bar 12, for example, by welding these components together. The brace rod 28 is welded to the sleeve 17, and a bar 42 is also welded to the sleeve. A pin or a screw 43 is inserted through and retained by any convenient means in any one of several holes in the bar 42 to extend far enough on the opposite side of the bar to engage the the edge of the brace rod 28 when the sleeve 17 is rotated counterclockwise by a certain angle from the starting position of a curl. The hole in which the pin 43 is mounted cannot be seen on account of the head of the pin, but the other holes 44 and 45 in the bar 42 can be seen. The reason for spacing the holes apart along the bar 42 is to be able to change the angle through which the sleeve 17 can be rotated before the pin 43 engages the edge of the bar. Doing so has the effect of allowing less free rotation of the sleeve 17 when the pin 43 is placed in the hole 44 than when it is in the hole in which it is located in FIG. 7 and less yet when it is in the hole 45. The effect of reducing the free movement of the sleeve is to cause the weight to be pivoted higher when the bodybuilder's arm moves through the full arc of a curl. It also determines how nearly horizontal the bracket arm 41 will be when the bodybuilder's arm is in its uppermost position, and this determines how heavy the weight will seem to the person performing the exercise.

Figure 8:
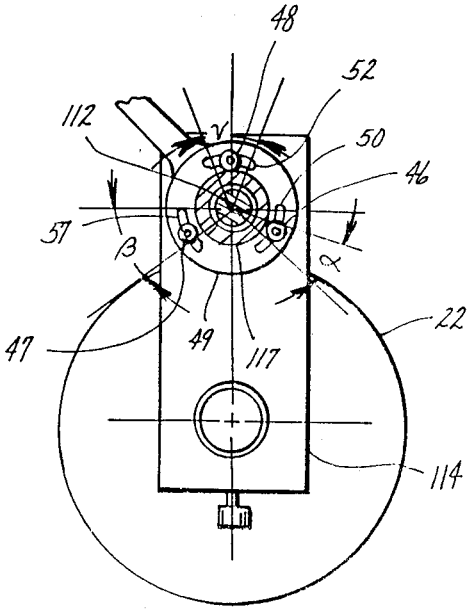
FIG. 8 shows a cross-sectional view of another embodiment of means to establish different limits for the angle through which the center of mass can shift.

FIG. 8 shows a modified bracket 114 that has three threaded holes, one of which has a screw 46 in it. The other holes are identified by reference numerals 47 and 48. A flange 49 is welded on the end of the sleeve 117 adjacent the bracket 114 and has three arcuate slots 50–52 in it aligned with the holes in the bracket. The three slots have different arcuate extents indicated by the angles $\alpha$, $\beta$, and $\gamma$ for the slots 50, 51, and 52, respectively.

The purpose of the slots is to control the extent to which the sleeve 117 can rotate with respect to the bar 112. By providing slots with different arcuate lengths, a bodybuilder using this device can choose the extent of free movement of the center of mass of the weight 22, relative to the brace rod 28. This, in turn, controls the effect felt by the bodybuilder, allowing him to select the effective weight used in the curling exercise even though the actual weight remains the same. For example, the effect of a total of 50 lbs. attached to the bar 112 can be made to seem like any amount up to about 80 lbs. or even more. Thus, bodybuilders seeking to improve their strength can keep raising the effective weight without using different weights 22 to do so.

Figure 9:
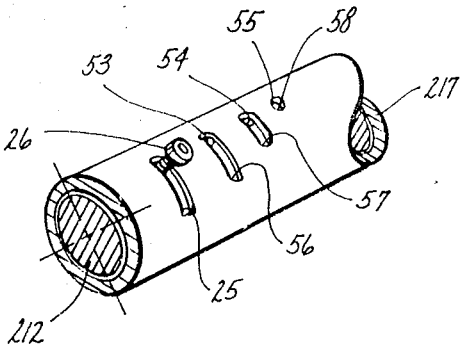
FIG. 9 shows a cross-sectional view of still another embodiment of means to control the angle through which the center of mass can shift.

In FIG. 9 a different arrangement for changing the effective weight is shown. The embodiment in this figure includes a bar identified by reference numeral 212 that is similar to, but not identical with, the bar 12 in FIG. 1 and is encircled by a sleeve 217 that freely rotates on it and is similar to, but not identical with, the sleeve 17 in FIG. 1. The bar 212 has a hole in which there is a screw 26 that extends through an arcuate slot 25 and it also has three other holes 53–55 threaded to accept the screw. The holes 53 and 54 are aligned with slots 56 and 57 that are progressively shorter than the slot 25, and the hole 55 is aligned with a hole 58. As in FIG. 8, the purpose of providing slots of different arcuate extent is to allow a bodybuilder to change the position at which the effective weight being used in the curling exercise feels as if it had changed. The effect of the hole 56 is to prevent any relative rotation between the bar 212 and the sleeve 217, thereby holding the weights 22 offset in a fixed position, and increasing the effective downward pull by a fixed amount, right from the start of the exercise.

The apparatus of this invention can also be used to build up the triceps. To do so, the bodybuilder lies on his back with his arms extended over his head and his hands encircling the sleeve 17 of the embodiment in FIG. 1 or the sleeves in any of the other embodiments. Contrary to the way the sleeve is grasped for a curl, the bodybuilder's right hand goes between the brace rod 28 and the sleeve, and his left hand goes between the brace rod 27 and the sleeve, and his thumbs are facing each other. As he lifts up on the sleeve 17, the weights remain on the floor or mat until the screw 26 reaches the end of the slot it is in. Then, further upward movement of the bodybuilder's arms lifts the weight, but he must exert more force to lift it than he would if the center of mass were not offset from the axis of the sleeve 17. The distance the bodybuilder can lift his arms before the weight moves depends on the arcuate length of the slot in which the screw 26 is engaged, and this distance can be controlled in the same manner as for a curl.

While this invention has been described in terms of specific embodiments to perform certain exercise, it will be understood by those skilled in the art that modifications may be made in the invention within the scope of the following claims:

I claim:

1. Weight lifting apparatus comprising:

a bar having an axis;

hand grip means rotatably mounted on the bar coaxially with it to be grasped by a user;

bracket means nonrotatably held relative to the bar;

weight support means on the bracket means and radially offset from the axis of the bar;

brace means connected to the hand grip means for rotating with the hand grip means relative to the bar and for engaging the back of the user's forearm; and means for controlling the angle of rotation of the hand grip means relative to the bar for keeping the brace means within a predetermined range of angular positions relative to the weight support means.

2. The weight lifting apparatus of claim 1 comprising means for holding the weight support means in several selected ranges of angular positions relative to the bar.

3. The weight lifting apparatus of claim 2 in which the means for holding the weight support means in the selected ranges of angular positions comprises locking means engaging the bar and means for locking the bracket means in certain specific angular settings relative to the bar.

4. The weight lifting apparatus of claim 1 comprising a first member rigidly affixed relative to the weight support means and a second member rigidly affixed to the hand grip means, the means for controlling the angle of rotation of the hand grip means comprising;

slot means in one of the members, the length of the slot corresponding to the predetermined range of angular positions; and pin means secured to the other of the members and extending through the slot, whereby the hand grip means can rotate relative to the bar within the predetermined range of position.

5. The weight lifting apparatus of claim 4 in which the hand grip means comprises a sleeve around the bar, the slot means comprises a slot extending along an arc part of the way around the sleeve, and the pin comprises a set screw threaded into the bar and extending out through the slot.

6. The weight lifting apparatus of claim 5 in which the bar comprises different receptacles in which to receive the pin to allow different ranges of angular separation between the weight support means and the brace means.

7. The weight lifting apparatus of claim 1, in which the bracket means comprises a first bracket member affixed to one end of the bar, and the means for controlling the angle of rotation of the hand grip means relative to the bar comprises:

an arm member affixed to the hand grip means adjacent the first bracket member;

engagement means on one of the members for engaging a predetermined part on the other member at a predetermined angular separation between the weight support means and the brace means.

8. The weight lifting apparatus of claim 7 in which the arm member comprises a plurality of holes, and the engagement means comprises a pin positionable in any of the holes to engage different locations on the bracket member.

9. The weight lifting apparatus of claim 1 in which the brace means comprises rod means rigidly attached to the hand grip means.

10. The weight lifting apparatus of claim 9 in which the hand grip means is a sleeve encircling the rod means and freely rotatable on it, and each end of the rod means is rigidly joined to the sleeve near the outer ends thereof adjacent the bracket means.

11. The weight lifting apparatus of claim 9 in which:

the bracket means comprise first and second brackets rigidly attached to opposite ends of the bar;

the hand grip means comprises a sleeve enclosing substantially all of the bar between the brackets; and the rod means comprises first and second rods, one end of each each rod being rigidly joined to the sleeve, and the other end of each rod extending generally toward the opposite end of the sleeve.

12. The weight lifting apparatus of claim 11 in which the one end of each rod extends outwardly from the sleeve, an intermediate portion of each rod is generally parallel to the bar, and the other end of each rod extends back generally toward the sleeve.

13. The weight lifting apparatus of claim 12 in which the one end and the other end of each rod are in different planes.

14. The weight lifting apparatus of claim 12 comprising a soft pad on the intermediate portion of each rod.

15. The weight lifting apparatus of claim 12 in which the intermediate portion of each rod is curved to fit more closely around the user's forearm.

16. Weight lifting apparatus particularly adapted for use in performing curls, said apparatus comprising:

an elongated bar having an axis;

first and second brackets attached to opposite ends of the bar;

first and second weight support means on the first and second brackets, respectively, the first and second weight support means being spaced from the axis of the bar for supporting weights thereon with the centers of mass of the weights being radially offset from the axis of the bar in the same direction and the same distance;

a sleeve encircling the bar between the first and second brackets and freely rotatable on the bar over a certain angular range, the sleeve and the bar comprising first and second relative rotation means, and the sleeve comprising hand grip means with first and second locations thereon to be gripped by a bodybuilder using the apparatus;

first and second brace rod means each having one end portion thereof affixed to the sleeve adjacent the first and second locations and extending outwardly from the sleeve in a first plane, the first and second brace rod means having a central portion thereof extending generally parallel to the axis of the bar, and the first and second end portion extending generally back toward the bar but in a second plane at an angle to the first plane;

arm-protection pads on the central portions of each of the brace rod means;

first and second members rigidly located on one of the rotation means and spaced apart angularly relative to the axis of the bar by a predetermined extent; and a third member rigidly located on the other rotation means and extending between the first and second members for moving within an angular range limited by the first and second members.

* * * * *